United States Patent [19]

Theurer et al.

[11] 4,130,063

[45] Dec. 19, 1978

[54] TAMPING HEAD

[75] Inventors: Josef Theurer, Vienna; Wilhelm Praschl, Linz-Urfahr, both of Austria

[73] Assignee: Franz Plasser Bahnbaumaschinen-Industriegesellschaft m.b.H., Vienna, Austria

[21] Appl. No.: 842,488

[22] Filed: Oct. 17, 1977

Related U.S. Application Data

[63] Continuation of Ser. No. 707,946, Jul. 23, 1976, abandoned.

[30] Foreign Application Priority Data

Sep. 16, 1975 [AT] Austria ..... 7101/75

[51] Int. Cl.[2] ..... E01B 27/20

[52] U.S. Cl. ..... 104/12

[58] Field of Search ..... 104/7 R, 10, 12; 92/13.1, 13.5, 13.6

[56] References Cited

U.S. PATENT DOCUMENTS

| | | | |
|---|---|---|---|
| 2,596,471 | 5/1952 | Densmore et al. | 92/13.1 X |
| 2,630,786 | 3/1953 | Poore | 92/13.1 X |
| 2,872,878 | 2/1959 | Plasser et al. | 104/12 |
| 3,357,366 | 12/1967 | Plasser et al. | 104/12 |
| 3,380,395 | 4/1968 | Plasser et al. | 104/12 |
| 3,429,276 | 2/1969 | Plasser et al. | 104/12 |
| 3,608,498 | 9/1971 | Plasser et al. | 104/12 |
| 3,779,170 | 12/1973 | Plasser et al. | 104/12 |

FOREIGN PATENT DOCUMENTS

| | | | |
|---|---|---|---|
| 2055489 | 5/1971 | Fed. Rep. of Germany | 92/13.1 |

*Primary Examiner*—Albert J. Makay
*Assistant Examiner*—Carl Rowold
*Attorney, Agent, or Firm*—Kurt Kelman

[57] ABSTRACT

A tamping head with a pair of vibratory and reciprocatory tamping tools mounted on a vertically adjustable carrier for immersion in the ballast in the cribs, with the ties positioned between the tools. Each tamping tool is constituted by a lever pivotal in a vertical plane about a transverse pivot, and stops are mounted on the carrier for setting at least three different reciprocating strokes for the tamping tools, with a remote-controlled multistep drive for setting the stops.

8 Claims, 5 Drawing Figures

TAMPING HEAD

This is a continuation of application Ser. No. 707,946, filed July 23, 1976, now abandoned.

The present invention relates to improvements in a tamping head for tamping ballast underneath a track including rails supported on a plurality of spaced ties resting on the ballast and defining cribs therebetween.

U.S. Pat. No. 2,872,878, dated Feb. 10, 1959, discloses a tamping head with a pair of tamping tools, a vertically adjustable carrier whereon the tamping tools are mounted for immersion in the ballast in the cribs adjacent respective ones of the ties, the ties being positioned between the tamping tools, each tamping tool being constituted by a lever pivotal in a substantially vertical plane extending in the direction of the track about a horizontal pivot extending substantially transversely to the track direction. The tamping tools are connected to power drives for reciprocating the tools in the plane about the pivot and for vibrating the tools, and stop means limit the reciprocation of the tamping tools within a range defined by a minimum and a maximum reciprocating stroke. According to the patent, the stop means is adjustably arranged to move from an inoperative position permitting a maximum reciprocating stroke into an operative position limiting the reciprocation to a minimum stroke, the stop means being operated by hydraulic drives so that successive single and double ties may be tamped selectively and in a continuous operation, the reciprocating stroke of the tamping tools being selected according to the width of the tie to be tamped. In this manner, double ties mounted under the rail joints may be tamped without substantial time delay as the tamping operation proceeds from tie to tie. However, a single adjustment of the reciprocating stroke to adapt to a double tie does not make it possible to tamp tracks with different tie spacings, such as the large tie spacings used in branch tracks and smaller tie spacing used on main lines. Furthermore, considerable difficulties and time delays have been encountered in tamping tracks whose tie spacings are irregular or whose tie spacings are regularly or irregularly reduced towards the rail joints, the spacing at the joints being no more than one or two tie widths. These difficulties are further increased with the type of tamping tool assembly wherein two pairs of tools are arranged for tamping two adjacent ties simultaneously.

It is the primary object of this invention to provide a tamping head of the indicated type which overcomes the described disadvantages and permits substantially continuous tamping in an operation proceeding from tie to tie, or groups of simultaneously tamped ties, without substantial time delays for adjustment to different tie spacings and/or widths.

The above and other objects are accomplished in accordance with the invention with a stop means arranged to set at least three different opening widths of pairs of cooperating tamping tools and including a remote-controlled multi-step drive for setting the stop means.

The present invention is based on the finding that a minimum of three settings determining the opening width of the tamping tools, the settings corresponding to the average differences in crib and/or tie widths, will make such an uninterrupted tamping operation possible under practically all practical track conditions. The remote control of the stop means drive, particularly from an operating station on a mobile track tamper, will enable the tamping to proceed about as rapidly as on tracks with regular tie spacing. In addition, the uniformity of the distance of the immersed tamping tools from the adjacent ties can be assured by the individual setting of each tool, thus improving the accuracy of the track positioning obtained by the tamping.

The above and other objects, advantages and features of this invention will become more apparent from the following detailed description of certain now preferred embodiments thereof taken in conjunction with the accompanying drawing wherein FIG. 1 is a schematic side view of a mobile track tamper incorporating one embodiment of a tamping head according to the invention, including a schematic showing of different settings for the opening width of the tamping tools;

Figures 1, 4, 5:
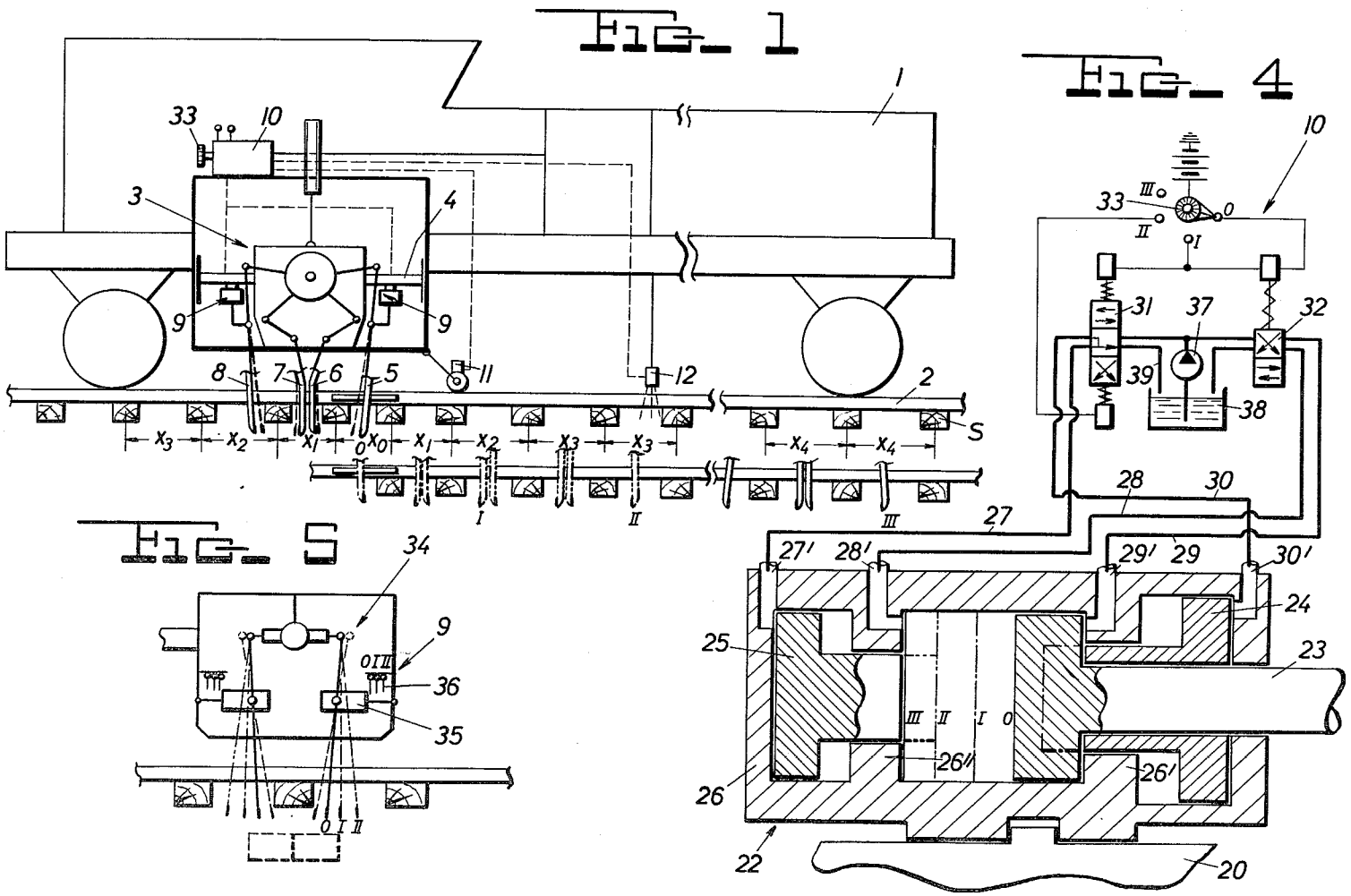
FIG. 4 shows the four-step drive of FIG. 2 on an enlarged scale.
FIG. 5 is a schematic side view of another embodiment of a tamping head according to this invention.

Referring now to the drawing and first to FIG. 1, a generally conventional mobile tamper is shown to comprise machine frame 1 mounted on undercarriages for mobility on track rails 2 supported on a plurality of spaced ties S resting on ballast (not shown) and defining cribs therebetween.

In this embodiment, tamping head 3 is of the type disclosed, for instance, in U.S. Pat. No. 3,357,366, dated Dec. 12, 1967, which comprises two pairs of tamping tools 5, 6 and 7, 8 mounted on vertically adjustable carrier 4 for immersion in the ballast in the cribs adjacent respective ones of the ties, the ties being positioned between the tamping tools. As shown, the pairs of tampng tools are spaced from each other in the track direction, the spacing being such that the tools 6 and 7 of each pair, which are adjacent to each other, are immersible in the same crib whereby two adjacent ties are respectively positioned between the adjacent tools 6, 7 and outer tools 5, 8 of the pairs.

Each tamping tool is constituted by a lever pivotal in a substantially vertical plane extending in the direction of the track about a horizontal pivot 16, 17 and 18, 19 extending substantially transversely to the track direction. A power drive means consisting in the illustrated embodiment of hydraulic motors 13, 13 and 14, 14 reciprocates the tamping tools in the plane about the pivots, and a power drive means consisting in the illustrated embodiment of central crank shaft drive 15 vibrates the tamping tools, all of the above-described structure being generally conventional and, therefore, being described only in general outlines.

According to the invention, stop means is arranged for setting four different opening widths, O, I, II and III by means of remote-controlled four-step drive 9 so that the opening of the tamping tools of each pair, i.e. their widest distance from each other, may be set to four different widths. Control 10 is mounted in the range of the operating station on the mobile tamper for independently actuating the drive for each tamping tool, a control circuit including a power source (not shown) and electrical conductors connecting remote control 10 to drives 9. The track tamper also comprises odometer 11 and tie sensor 12.

The tie spacing of the track shown in FIG. 1 is irregular, the distances between adjacent ties S gradually decreasing towards the rail joint located in the range of tamping tool 5. Thus, in addition to the average tie spacing $X_3$, wider tie spacings $X_4$ are noted in the range of the front undercarriage remote from the rail joint and decreasingly smaller tie spacings $X_2$, $X_1$ and $X_0$ are found as the rail joint is approached and at the joint. The setting of the tamping tool distances from each other to adjust to these different spacings will be more fully explained in connection with FIG. 4.

Figure 3:
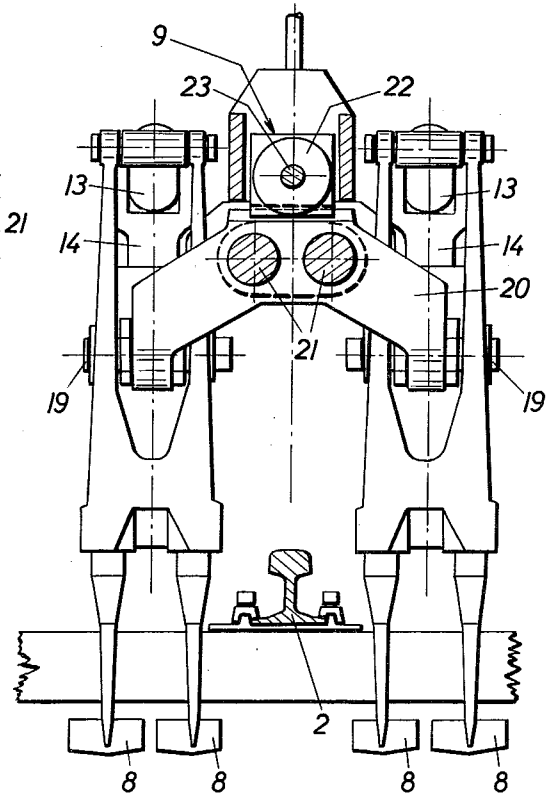
FIG. 3 is a section along line III—III of FIG. 2.
Figure 2:
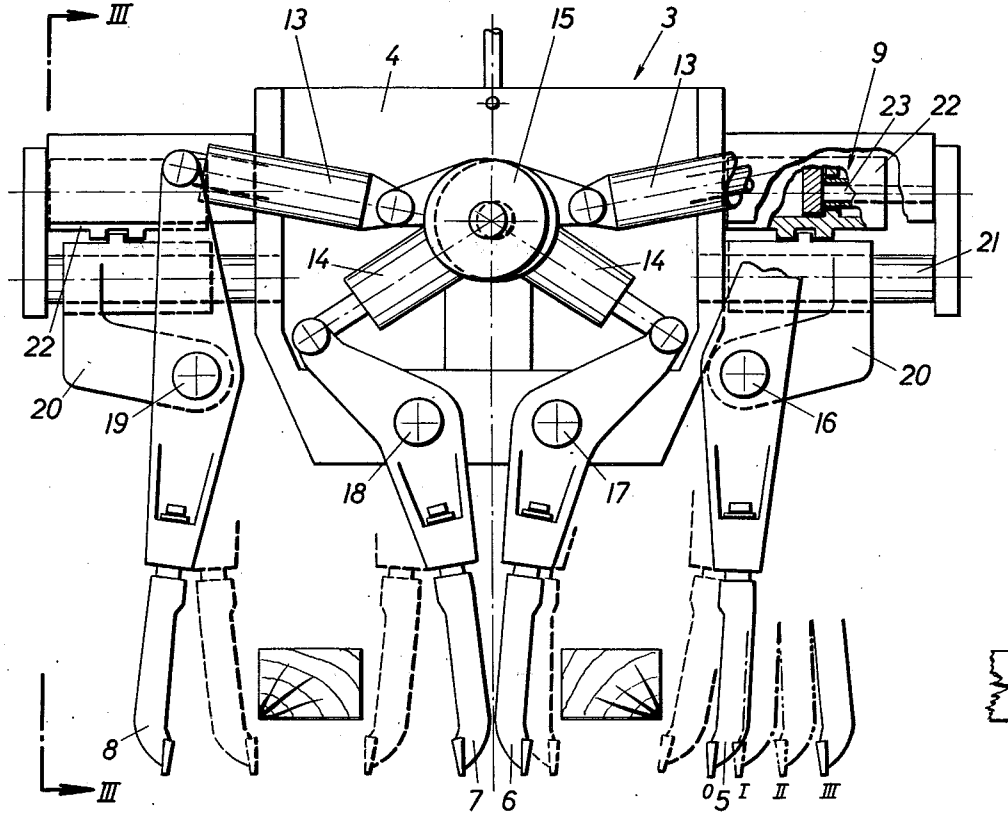
FIG. 2 is an enlarged side view of the tamping head of FIG. 1, partly in section to show a detail of the stop means drive.

As shown in FIGS. 2 and 3, each tamping tool includes a tool holder and the pivots are positioned substantially equidistantly from the ends of the tamping tool holders intermediate thereof. Pivots 17 and 18 for adjacent tamping tools 6 and 7 are mounted on carrier 4 while pivots 16 and 19 for outer tamping tools 5 are linked to one end of two-armed levers 20, 20 mounted on the tamping tool carrier. As illustrated in FIG. 3, the tamping tools are arranged for immersion in the ballast adjacent both sides of each rail being reciprocable about a common pivot, and the one end of two-armed lever 20 being linked to the common pivots. Guides 21 extend in the direction of track elongation and mount each bell crank lever 20 for movement therein in this direction. This guide is constituted in the illustrated embodiment by guide beam 21 on which the bell crank lever is glidably journaled to constitute the four-position adjustment for reciprocation of tamping tools 5 and 8.

The illustrated arrangement provides a very simple and sturdy construction which also is kinematically very advantageous because the tamping tool pivots are directly linked to the lever which sets the reciprocating stroke. With the pivot being centered between the ends of the tamping tool holders, the tamping tools will remain in essentially vertical positions in all settings, which improves the compaction of the ballast and the formation of a solid ballast bed, and also facilitates the immersion of the tamping tools into the ballast.

By moving bell crank levers 20 along guide beam 21 by means of four-step cylinder-and-piston drive 22, outer tamping tools 5 and 8 of each pair of tools may be set selectively in positions 0, I, II and III, as shown in FIG. 2, which settings determine the distance between the tamping tools and, thus, the width of the opening between the tools of each pair 5, 6 and 7, 8 in the range between a minimum setting 0, shown in full lines in connection with tamping tools 5, 6, and a maximum shown in full lines in connection with tamping tools 7, 8. The tamping tools are shown in broken lines at the end of reciprocation produced by drives 13 and 14.

Drive 22 is shown on an enlarged scale and in detail in FIG. 4. The illustrated four-step drive comprises stationary main piston 23 mounted on tamping tool carrier 4, two auxiliary pistons 24, 25 associated therewith and cylinder 26 common to the pistons and axially movable in relation thereto, the setting lever 20 being coupled to the cylinder for movement therewith. Cylinder 26 defines a cylinder chamber into which project annular abutments 26′ and 26″ for the respective pistons for delimiting the path of movement of the cylinder relative thereto. Four hydraulic pressure fluid passages 27′, 28′, 29′ and 30′ in the cylinder connect the cylinder chamber to conduits 27, 28, 29 and 30, respectively, which lead to solenoid valves 31 and 32 whose inlets are connected to the output of constant speed pump 37 delivering hydraulic fluid from sump 38, return lines 39 returning the hydraulic fluid to the sump. A control circuit including selector switch 33 and a power source (not shown) is connected to the solenoids of the valves which form part of control 10 for drive 22.

The illustrated four-step drive operates in the following manner:

When selector switch 33 of control 10 is in the illustrated "0" position, the solenoid of valve 32 is energized and the valve is in the illustrated operating position which connects conduit 28 to the hydraulic fluid supply. In this position, hydraulic fluid is delivered into the cylinder chamber through inlet 28′ to move cylinder 26 to the left, as seen in FIG. 4, placing tamping tool 5 into the 0 position which produces the minimum opening of tamping tool pair 5, 6. This position is useful, for instances, to permit tamping tool 5 to enter into the crib at the smallest tie spacing $X_0$ (See FIG. 1).

When selector switch 33 is moved to the "I" position, one of the solenoids of valve 31 is also energized to cause hydraulic fluid to be delivered into conduit 30 whence it flows through inlet 30′ to press against auxiliary piston 24, causing cylinder 26 to be moved to the right until abutment 26′ engages piston 24 to assume position I shown in chain-dotted lines, valve 32 being actuated to connect conduit 28 with return line 39 to permit displaced hydraulic fluid to flow back to the sump. Position I, as illustrated in FIGS. 1 and 2, is useful in the intermediate $X_2$ tie spacing.

Chain-double dotted tamping tool position II is obtained by throwing switch 33 into the "II" position in which only the second solenoid of valve 31 is energized to deliver hydraulic fluid through conduit 27 into inlet 27′ against auxiliary piston 25 while valve 32 is in the rest position connecting conduit 29 to sump 38 to deliver hydraulic fluid through inlet 29′ against main piston 23. Under this pressure against pistons 23 and 25, cylinder 26 will move further to the right until auxiliary piston 25 engages abutment 26″, displaced fluid flowing out of the cylinder chamber through conduit 28. This tamping tool position will be useful in tie spacings $X_3$.

Where the tie spacing is widest, at $X_4$, selector switch 33 will be rotated into position "III". In this position, all the solenoids are de-energized, valves 31 and 32 are in their rest positions, and hydraulic fluid is delivered from sump 38 through conduit 29 against main piston 23 to press cylinder 26 all the way to the right into position III where piston 23 engages abutment 26″.

As FIG. 1 shows, three different tie spacings are usually encountered in tracks between their respective rail joints, with a fourth spacing found at the joints where the spacing is usually very narrow or double ties are positioned. With the settings provided by the illustrated four-step drive, the necessary adjustments of the opening widths of the tamping tools may be readily effected.

The adaptation of tamping heads designed for tamping two ties simultaneously to varying tie spacings has been particularly difficult and, as has been described hereinabove this problem has been successfully solved by the four-step drive of this invention, which enables the tamping tool pairs to be set to four different opening widths without significantly encumbering the structure or operation. The hydraulic cylinder-and-piston drive is a very compact mechanism operating dependably and taking up a minimum of space. The control of the drive may be effected from the operator's cabin of the tamper independently for each tie and rail to adapt the tamping operation to local irregularities, the adjustments being made without delay and difficulty.

The multi-step setting of this invention may, of course, also be used with tamping heads mounting a single pair of tamping tools, as schematically shown in FIG. 5. The generally conventional tamping head 34 mounts a pair of tamping tools reciprocated about a central pivot by hydraulic drives 35, the cylinders of the drives selectively engaging respective limit switches 36 during reciprocation to set drive 9 in respective positions 0, I and II. As shown in chain-double dotted lines, in tamping tool setting II, the opening widths of the tools is sufficiently wide to enable a double tie to be tamped.

It is within the scope of the present invention to use a common control 10 for the four tamping tools 5 or 8 (see FIG. 3) which are arrayed transversely of the track on both sides of a respective rail 2. If separate controls are used for the tamping tools on each side of the rail, their reciprocating strokes may be individually and independently adjusted, which is particularly useful with the two-tie tamping heads of the type shown in FIG. 2.

What is claimed is:

1. In a tamping head for tamping ballast underneath a track including rails supported on a plurality of spaced ties resting on the ballast and defining cribs therebetween, which comprises a pair of tamping tools, a vertically adjustable carrier whereon the tamping tools are mounted for immersion in the ballast in the cribs adjacent respective ones of the ties, the ties being positioned between the tamping tools, each tamping tool being constituted by a lever pivotal in a substantially vertical plane extending in the direction of the track about a horizontal pivot extending substantially transversely to the track direction, power drive means for reciprocating the tamping tools about the pivots thereof and for vibrating the tamping tools, stop means associated with one of the tamping tools for positioning the pivot of the one tamping tool in at least three different fixed positions with respect to the pivot of the other tamping tool of the pair in the track direction, and a remote control for operating the stop means to move the stop means into a selected one of the fixed positions whereby the distance between the pivots of the tamping tools of the pair is changed without changing the stroke of the reciprocating power drive means, the stop means including a multi-step drive operated by the remote control for setting the stop means at the selected position.

2. In the tamping head of claim 1, the stop means comprising a two-armed lever mounted on the tamping tool carrier and having one end linked to the pivot of the one tamping tool, and a guide extending in the track direction and mounting the lever for movement therealong, the multi-step drive being arranged to control the movement of the lever along the guide into the selected position.

3. In the tamping head of claim 2, the pair of tamping tools comprising tamping tools arranged for immersion in the ballast adjacent both sides of each rail, each group of tamping tools adjacent both sides of each rail being reciprocable about a common pivot, and the one end of the two-armed lever being linked to the common pivots.

4. In the tamping head of claim 2, each tamping tool including a tool holder and the pivot being positioned substantially equidistantly from the ends of the tamping tool holders intermediate thereof.

5. In the tamping head of claim 1, the multi-step drive being a hydraulically operated four-step cylinder-and-piston device.

6. In the tamping head of claim 5, the cylinder-and-piston device comprising a stationary main piston, two auxiliary pistons associated therewith, and a cylinder common to the pistons.

7. In the tamping head of claim 1, mounted on a mobile track tamper comprising an operating station, the remote control being arranged at the station for independently actuating the multi-step drive for each tamping tool.

8. In the tamping head of claim 1, two of said pairs of tamping tools spaced from each other in the track direction, the spacing between the pairs of tamping tools being such that the tools of each pair, which are adjacent to each other, are immersible in one of the cribs whereby two adjacent ones of the ties are respectively positioned between the adjacent tools of the pairs and the outer tools of the pairs, a respective one of the multi-step drives being linked to the pivot of the outer tamping tool of each pair.

* * * * *